United States Patent [19]

Takeo

[11] 3,966,425

[45] June 29, 1976

[54] STAINLESS STEEL WIRE HAVING NICKEL PLATED LAYER

[75] Inventor: Keinosuke Takeo, Itami, Japan

[73] Assignee: Sumitomo Electric Industries, Ltd., Osaka, Japan

[22] Filed: Feb. 27, 1975

[21] Appl. No.: 553,720

Related U.S. Application Data

[63] Continuation of Ser. No. 20,186, March 17, 1970, abandoned.

[30] Foreign Application Priority Data

Mar. 18, 1969 Japan ..... 44-21144

[52] U.S. Cl. ..... 29/191.6; 29/196.6

[51] Int. Cl.[2] ..... B32B 15/00

[58] Field of Search ..... 29/196.6, 191.6

[56] References Cited

UNITED STATES PATENTS

| | | | |
|---|---|---|---|
| 3,490,126 | 1/1970 | Miller | 29/196.3 |
| 3,505,039 | 4/1970 | Roberts | 29/191.6 |

*Primary Examiner*—Arthur J. Steiner

*Attorney, Agent, or Firm*—Sughrue, Rothwell, Mion, Zinn & Macpeak

[57] ABSTRACT

A stainless steel wire, having a better anti-corrosive nature, can be easily formed into a coiled spring by means of an automatic coiling machine and is obtained by coating the stainless steel wire with a suitable thickness of a nickel layer on the outer surface of the stainless steel wire.

1 Claim, 1 Drawing Figure

NICKEL PLATED STAINLESS STEEL WIRE
FATIGUE TEST (0.5kg-m stress bar)
TORSIONAL FATIGUE by SCHENK $\tau_a/\tau_m = 0.31$
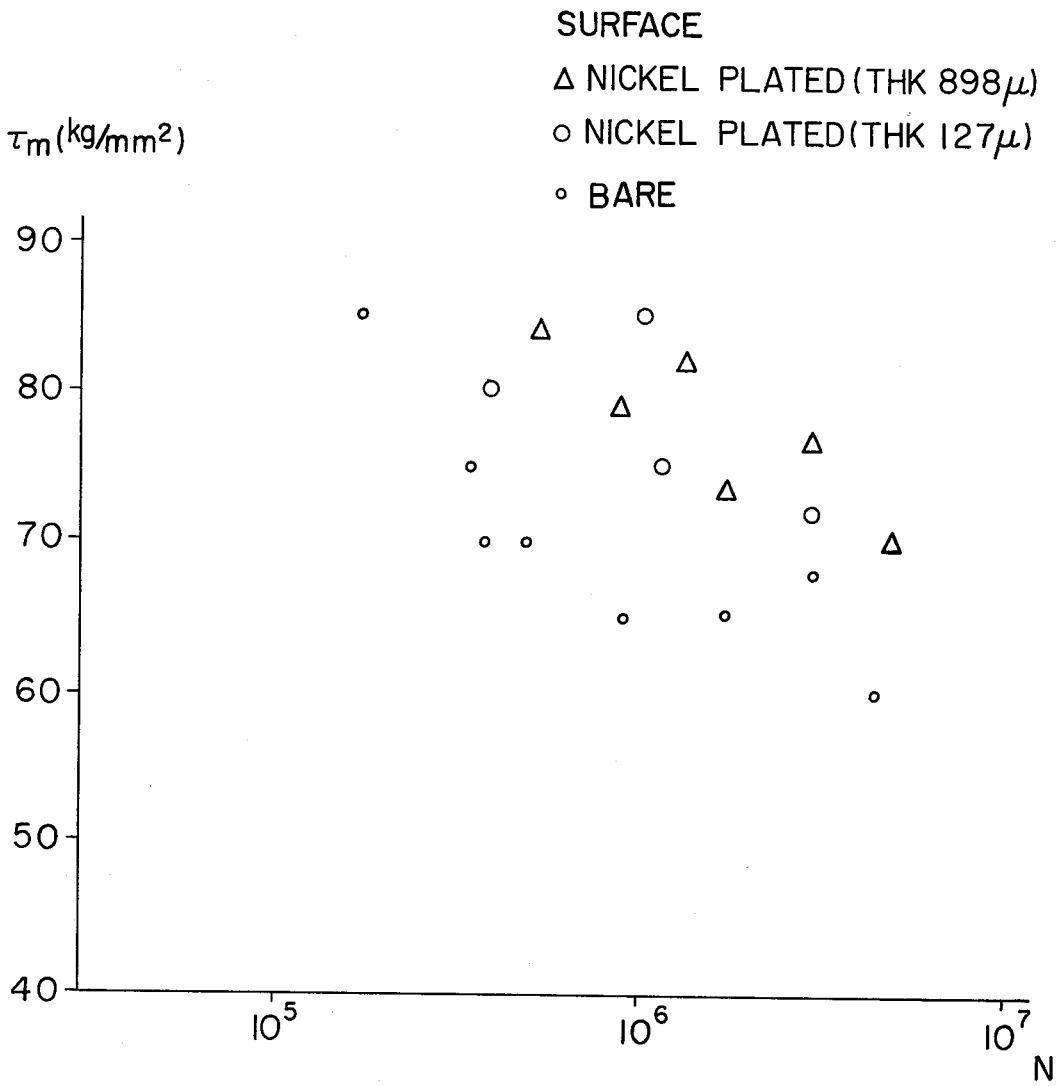
INVENTOR
BY
ATTORNEY

STAINLESS STEEL WIRE HAVING NICKEL PLATED LAYER

This is a Continuation, of application Serial No. 20,186, filed Mar. 17, 1970, now abandoned.

BACKGROUND OF THE INVENTION

1. Field of the Invention

This invention relates generally to a stainless steel wire, and more specifically to a type of stainless steel wire having a nickel plated layer on the outer surface of the stainless steel wire.

2. Description of the Prior Art

Various types of stainless steel wire of superior anti-corrosive nature are known, and these are widely employed in the production of coiled springs.

However, when the stainless steel wire is formed into coiled springs, some difficulties in the coiling process are experienced. The most fundamental of these difficulties is the frictional seizure or galling caused between the stainless steel wire and the feed rollers, the wire guide, and the bending die of an automatic coiling machine. If such frictional seizure occurs, irregularities in the dimensions or in the structure of the coiled springs inevitably result, and the operation of the coiled springs thus produced are not constant. Furthermore, wear in the feed rollers and bending die is severe, rendering the production of the coiled springs utterly unsuccessful.

In order to avoid such difficulties, a stainless wire plated with lead or coated with a suitable resin has been employed in automatic coiling machines.

However, where a stainless steel wire plated with lead is employed, there is always a hazard from pulverized lead, which is poisonous to te human body, being spread around the coiling cite. Furthermore, both the lead plated and the resin covered stainless steel wire easily change in color during the stress relieving process (at about 400° C) carried out after the coiling process, rendering the coiled springs esthetically unpleasant, and requiring another process for removing the lead or resin layer before the stress-relieving process.

Therefore, the primary object of the present invention is to provide a stainless steel wire so processed that the above described drawbacks of conventional stainless steel wires can be essentially eliminated.

Another object of the present invention is to provide a stainless steel wire which possesses sufficient lubrication when it is processed in a coiling machine.

Still another object of the present invention is to provide a stainless steel wire which preserves its aesthetically pleasant features even after it is subjected to a stress-relieving process following the coiling process.

An additional object of the invention is to provide a stainless steel wire which also preserves its anti-corrosive nature after it is subjected to the stress-relieving and coiling processes.

SUMMARY OF THE INVENTION

This problem was studied intensly and it was found that the lubricating nature of a stainless steel wire during drawing to a reduced diameter can be improved substantially when the stainless steel wire is plated with a suitable thickness of a nickel layer, and that the nickel plated layer remaining after the drawing process still can exhibit a good lubricating nature during subsequent formation into coiled springs in an automatic coiling machine. Furthermore, the nickel plated layer on the stainless steel wire does not change in color even if it is annealed after it is formed into coiled springs for internal stress removal. Good anti-corrosive characteristics are retained also after all of the above mentioned processes.

Therefore, the characteristic feature of the stainless steel wire according to the present invention is that the stainless steel wire is covered with a suitable thickness of nickel layer.

The nature, principle, and utility of the present invention will be made more apparent from the following description with reference to the accompanying drawings.

BRIEF DESCRIPTION OF THE DRAWING

The drawing shows the results obtained in tests of the fatigue characteristics of examples of this invention and for conventional stainless steel wire.

DETAILED DESCRIPTION OF THE INVENTION

As described above, a good lubricating nature is exhibited in the coiling process carried out on an automatic coiling machine when a stainless steel wire supplied to the coiling machine is plated with a nickel layer of a suitable thickness. The anti-corrosive nature and the aesthetically pleasant appearance of the stainless steel wire can be preserved even after the coiling process and the stress-relieving process.

Although nickel plating on a stainless steel wire is known, the thickness of the layer thus plated should be selected in a suitable range in order to obtain a satisfactory result in the coiling process and in the subsequent stress-relieving process and also to obtain anti-corrosive characteristics.

To determine the anti-corrosive characteristics of the nickel plated stainless steel wire, the following samples: (1) a stainless steel wire having no nickel layer, (2) a stainless steel wire having a nickel layer of 0.5 micron thickness, (3) a stainless steel wire having a nickel layer of 3 microns thickness, (4) a stainless steel wire having a nickel layer of 9 microns thickness, and (5) a stainless steel wire having a nickel layer of 20 microns thickness, were subjected to the following anticorrosive tests:

a. Maintaining the samples in contact with 10% hydrochloric acid at 40° C for 3 hours;
b. Maintaining the samples in contact with 5% boiling sulfuric acid for 3 hours;
c. Maintaining the samples in contact with 20% boiling sodium hydroxide for 6 hours;
d. Maintaining the samples in contact with sulfur dioxide at dry and wet conditions for 1 week; and
e. Maintaining the samples under a salt water spray (JIS Z-2371, 1955) for 1000 hours.

The results of the above described tests demonstrated that sample (1) was far inferior in anti-corrosive characteristics in comparison with the other samples and that the thicker the nickel layer of the stainless steel wire the greater the resistance to corrosion.

The above described five samples were further subjected to 40% boiling nitric acid for 6 hours, and it was found that sample (1), having no nickel layer, was corroded the least, and that with the other samples, (2) through (5), which had nickel layers, the nickel layers were completely corroded during the 6 hours. Of course, the speed of corrosion for these samples after the nickel layer has been corroded away was similar to the sample (1) having no nickel layer.

As for the lubricating nature of the nickel plated stainless steel wire at the time of being coiled into coiled springs which constitutes the principal object of such a construction, it was found that the coiling speed of the nickel plated stainless steel wire was three times faster than that of the stainless steel wire having no coating, and was about 30% faster than the coiling speed of a conventional stainless steel wire having lead or resin coating.

As for the yield rate of the products, it was found that the yield rate for the stainless steel wire having a nickel plated layer according to the present invention was as high as 80% whereas the yield rate for a conventional stainless steel wire having a lead or a resin coating was about 65 to 70%, rendering about a 10 to 15% improvement over the conventional construction.

As for the thickness of the nickel plated layer on the stainless steel wire, which is suitable, the thickness is determined by not only the lubricating nature desired at the time of coiling process but also the elasticity and the fatigue characteristics of the coiled spring desired, since the existence of the nickel plated layer lowers the latter. In addition, if the coiled spring having the nickel plated layer is to be used in a nitric acid gas atmosphere, even though such applications are very rare, the thickness desired must be considered.

At the time a stainless steel wire having a nickel plated layer, is coiled into a coiled spring, a nickel plated layer of less than 0.1 micron thickness was found to be ineffective in eliminating frictional seizure between the bending die and the stainless steel wire to be coiled, although this differs somewhat depending on the diameter of the stainless steel wire.

On the other hand, when the thickness of the nickel plated layer exceeds 10 microns, the cost of the nickel layer itself is increased. In addition, the fatigue characteristics of the coiled spring thus produced is lowered with a nickel layer exceeding 10 microns.

From the above described considerations, a suitable thickness of the nickel plated layer on the stainless steel wire to be produced into coiled springs is in the range of from 0.1 micron to 15 microns and preferably in a range of from 1 micron to 10 microns.

Therefore, the feature of the stainless steel wire according to the present invention is that the outer surface of the stainless steel wire has been previously electrically plated with a nickel layer and is drawn in a cold state into a stainless steel wire to be formed into coiled springs. Because of the existence of the nickel plated layer, the lubricating nature of the stainless steel wire is substantially improved while it is drawn into a wire of reduced diameter, and the wear of the drawing die is also markedly reduced. For this reason, it will be apparent that the stainless steel wire having a nickel plated layer is well adapted to the mass production of the drawn wires, and since an extremely thin nickel layer remains on the outer surface of the stainless steel wire, the wire thus produced has a superior nature when it is produced into coiled springs.

Although a stainless steel wire which is nickel plated after it has been drawn to a desired diameter cannot exhibit the advantageous features obtained both in its production and in its utilization, a good coiling nature and the nature for preventing color variation still result. Such a stainless steel wire is intended to be included in the scope of the present invention.

Furthermore, the results of the above described fatigue tests conducted on the coiled spring of the present invention and on conventional coiled springs having no nickel plated layer, are shown in the attached graphical representation, from which it is apparent that the fatigue characteristics of the coiled springs according to the present invention are superior to those of the conventional coiled springs.

What is claimed is:

1. A cold drawn wire, useful in forming coiled springs without frictional seizure or galling, comprising a stainless steel wire having a plated coating consisting essentially of nickel thereon of a thickness of from 0.1 to 15 microns.

* * * * *